US007617882B1

(12) United States Patent
Street

(10) Patent No.: US 7,617,882 B1
(45) Date of Patent: Nov. 17, 2009

(54) POWERED SAND GROOMING VEHICLE WITH YIELDABLE FRONT BULLDOZER BLADE ATTACHED TO STEERABLE FRONT WHEEL

(75) Inventor: Benjamin A. Street, Northfield, MN (US)

(73) Assignee: The Toro Company, Bloomington, MN (US)

( * ) Notice: Subject to any disclaimer, the term of this patent is extended or adjusted under 35 U.S.C. 154(b) by 0 days.

(21) Appl. No.: 10/765,563

(22) Filed: Jan. 27, 2004

(51) Int. Cl.
*E02F 3/76* (2006.01)

(52) U.S. Cl. ..... 172/817; 172/833; 33/266

(58) Field of Classification Search ..... 172/817, 172/816, 833, 272, 280; 414/686, 723; 37/231, 37/232, 241, 407, 266, 270, 271
See application file for complete search history.

(56) References Cited

U.S. PATENT DOCUMENTS 2,000,260 A * 5/1935 Snyder ..... 280/160
2,228,490 A * 1/1941 Smitth ..... 172/833
2,277,880 A * 3/1942 Noble ..... 172/134
2,678,596 A * 5/1954 Todd ..... 172/444
3,422,553 A * 1/1969 Holloway ..... 37/231
3,484,964 A * 12/1969 Jeffrey, Jr. ..... 414/635
3,722,915 A * 3/1973 Gail ..... 172/439
3,815,687 A * 6/1974 Federspiel ..... 172/817
4,597,205 A * 7/1986 Guest ..... 37/241
4,825,570 A * 5/1989 Schmid et al. ..... 37/231
5,088,215 A * 2/1992 Ciula ..... 37/197
5,950,735 A * 9/1999 Godbersen ..... 172/439
6,145,222 A * 11/2000 Curtis ..... 37/231
6,347,671 B1 * 2/2002 Stiller et al. ..... 172/439

OTHER PUBLICATIONS

Toro Sand Pro Brochure, 1998, Dozer Blade, p. 3.
Smithco Brochure showing Manual and Hydraulic Front Blades, undated but admitted prior art.

* cited by examiner

*Primary Examiner*—Thomas B Will
*Assistant Examiner*—Jamie L McGowan
(74) *Attorney, Agent, or Firm*—James W. Miller

(57) ABSTRACT

A vehicle for grooming sand or the like includes a quick attachment for connecting a front bulldozer blade or other implement to a steerable front wheel of the vehicle. When the front wheel pivots while steering, the front blade pivots with the front wheel to minimize catching the front blade on the lip or edge of a golf course bunker. The front blade is pivotal relative to the quick attachment against the bias of springs to minimize the tendency of the blade to dig into the sand. The pivotal motion of the front blade can be locked out if desired. The quick attachment is connected by a four bar linkage to the vehicle.

13 Claims, 5 Drawing Sheets

POWERED SAND GROOMING VEHICLE WITH YIELDABLE FRONT BULLDOZER BLADE ATTACHED TO STEERABLE FRONT WHEEL

TECHNICAL FIELD

This invention relates to a powered movable vehicle for grooming a surface comprised of sand or the like. More particularly, this invention relates to an implement that steers with the steerable front wheel of the vehicle. One such steerable implement comprises a yieldable front bulldozer blade for pushing sand ahead of the vehicle.

BACKGROUND OF THE INVENTION

Small powered vehicles are known for grooming sand surfaces such as those found in the bunkers of golf courses. These vehicles typically have three ground engaging wheels arranged in a tricycle configuration comprising a steerable front wheel and two rear wheels. An operator sits on a seat on the vehicle and is able to drive and steer the vehicle using a steering wheel adjacent the seat. The steering wheel is operably connected to the steerable front wheel of the vehicle. The SAND PRO® brand of bunker rakes manufactured and sold by The Toro Company, the assignee of this invention, is a well known line of sand grooming vehicles of this type.

A trailing rake is towed behind sand grooming vehicles of this type to engage and smooth the sand. Traditionally, such rakes have included a plurality of independently movable rake sections with each rake section having a plurality of rigid teeth. The rake teeth engage and groom the sand as the rake is pulled over the sand by the vehicle and the rake teeth pass through the sand. In some rakes, the rake teeth comprise spring teeth rather than rigid teeth for providing a smoother finish on the sand.

In addition to grooming a sand surface, such vehicles and rakes are also used to groom and smooth other surfaces comprised of loose granular material. For example, such vehicles and rakes are also used to groom the loose dirt forming the infields of baseball diamonds. Thus, such vehicles and rakes are not used exclusively for grooming sand, but can also groom surfaces made of other loose granular material.

In addition to trailing rakes, front bulldozer blades have previously been attached to the front of such sand grooming vehicles for pushing or grading sand ahead of the vehicle. Such blades are often used after rain or other weather has caused the distribution of the sand in the bunker to shift. After this happens, it is not enough to simply groom and smooth the sand using the trailing rake. Instead, the sand is desirably redistributed within the bunker before the sand grooming operation. A bulldozer blade attached to the front of the vehicle is used to accomplish such redistribution.

However, known bulldozer blades for sand grooming vehicles present various problems. They are not easy to install or remove from the vehicle. As a consequence, they are simply generally left on the vehicle. When in place on the vehicle but not in use, they are in the way and make the vehicle somewhat more difficult to steer.

Another problem with known bulldozer blades on sand grooming vehicles is that they are prone to catching on the edges of the bunkers when the vehicle is being driven along one of the bunker edges. Since many bunkers on golf courses have highly curved and contoured edges, the problem of steering along a bunker edge with a front bulldozer blade attached to the vehicle frame is a difficult one. Without constant attention and/or a highly skilled operator, it is easy to catch the blade on the bunker edge any number of times. Each time this happens, the turf adjacent the bunker edge can be damaged. As a result, this limits how close to the bunker edge a vehicle with a front mounted bulldozer blade can be driven, which is a disadvantage.

In addition, known bulldozer blades of this type are normally fixed with respect to the vehicle frame though they can be raised and lowered by the operator to adjust their grading or blading effectiveness. Again, however, this requires a fair amount of attention and skill on the part of the operator. It is easy when using such a blade to dig too deeply into the sand surface and begin to push too much sand. The operator must continually monitor the blade and raise and lower the blade as the vehicle drives forwardly to prevent the blade from pushing too much sand. This is a difficult operation for many operators to accomplish regardless of whether the blade is manually or hydraulically raised and lowered.

SUMMARY OF THE INVENTION

One aspect of this invention relates to a grooming vehicle which comprises a frame supported for movement by a plurality of ground engaging wheels comprising two rear wheels and a steerable front wheel. At least some of the wheels are driven to allow the frame to be self-propelled. A support is provided on which the steerable front wheel is rotatably journalled. The front wheel support is further pivotal about a vertical pivot axis to pivot the front wheel from side to side to steer the vehicle. A ground grooming implement is carried on the front wheel support of the steerable front wheel to pivot with the front wheel about the vertical pivot axis as the front wheel pivots about the vertical pivot axis.

Another aspect of this invention relates to a grooming vehicle which comprises a frame supported by a plurality of ground engaging wheels. A blade is coupled by an attachment to a front of the frame for pushing granular material on a granular material surface. The blade is pivotally connected to the attachment for pivoting about a substantially horizontal axis relative to the attachment when the blade is in engagement with the granular material to allow the blade to become more or less inclined relative to the granular material as the vehicle traverses over the granular material surface.

Another aspect of this invention relates to a grooming vehicle which comprises a frame supported by a plurality of ground engaging wheels. A blade is coupled by an attachment to a front of the frame for pushing granular material on a granular material surface. The blade is pivotally connected to the attachment for pivoting about a substantially horizontal axis relative to the attachment when the blade is in engagement with the granular material to allow the blade to become more or less inclined relative to the granular material as the vehicle traverses over the granular material surface.

Another aspect of this invention relates to a grooming vehicle which comprises a frame supported for movement over the ground by a plurality of ground engaging wheels. At least one wheel is driven to self-propel the frame over the ground. A first quick attachment comprises male and female couplers, the couplers interfitting with one another with the female coupler nesting at least partially over the male coupler. The first quick attachment is provided on a front of the frame. A second quick attachment comprises male and female couplers, the couplers interfitting with one another with the female coupler nesting at least partially over the male coupler. The second quick attachment is provided on a rear of the frame. A first implement designed for a ground grooming operation is mounted to the female coupler of the first quick attachment to allow the first implement to be mounted to the front of the frame. A second implement designed for a ground grooming operation is mounted to the female coupler of the second quick attachment to allow the second implement to be mounted to the rear of the frame.

BRIEF DESCRIPTION OF THE DRAWINGS

This invention will be described more completely in the following Detailed Description, when taken in conjunction with the following drawings, in which like reference numerals refer to like elements throughout.

DETAILED DESCRIPTION

Figure 1:
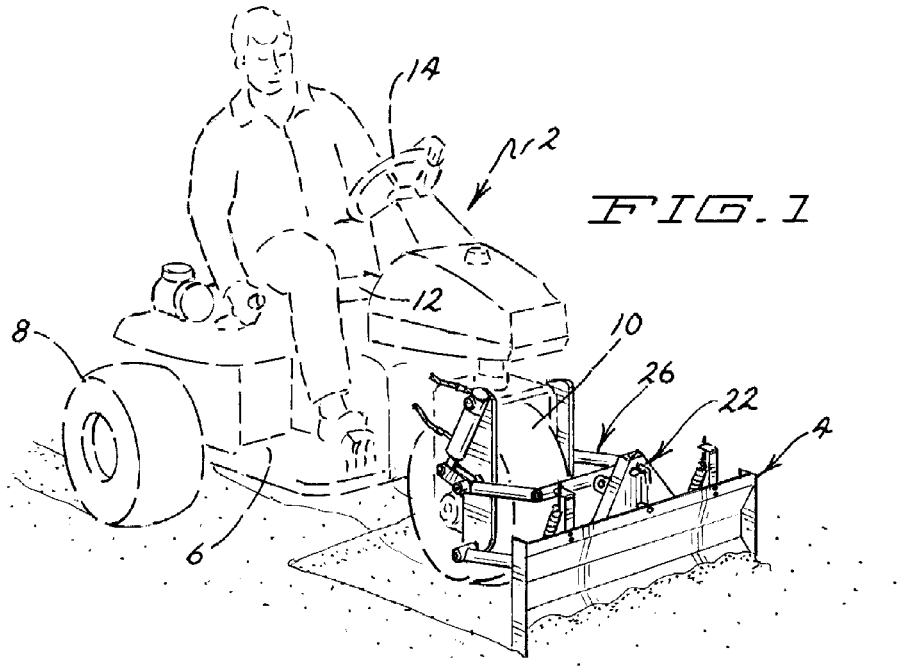
FIG. 1 is a perspective view of a sand grooming vehicle and front bulldozer blade according to this invention.

FIG. 1 illustrates the front of a sand grooming vehicle 2 equipped with a front bulldozer blade 4 according to this invention. Blade 4 is mounted on the front of vehicle 2 and is pushed by vehicle 2 to push and grade sand such as is found in a golf course bunker. Blade 4 is configured and attached to vehicle 2 in ways that improve on known prior art blades of this type. In addition, vehicle 2 is useful with implements other than blade 4.

Referring first to FIG. 1, vehicle 2 has a frame 6 supported by three ground engaging wheels arranged in a tricycle configuration. The wheels include a pair of rear drive wheels 8 and a steerable front wheel 10. A seat 12 is provided on frame 6 of vehicle 2 for carrying a seated operator. Seat 12 is positioned generally between rear drive wheels 8. The operator can steer the steerable front wheel 10 from one side to the other to steer vehicle 2 by gripping and turning a steering wheel 14 adjacent the operator's seat 12. Front wheel 10 could be driven as well.

As shown herein, vehicle 2 comprises a SAND PRO® brand bunker rake manufactured and sold by The Toro Company, the assignee of this invention. SAND PRO® brand bunker rakes are well known in the art.

Front wheel 10 is carried by a support 16 having spaced downwardly extending legs 18. Front wheel 10 is rotatably journalled between legs 18 of support 16 for rotation about a substantially horizontal axle 20. Support 16 is also pivotally carried on frame 6 of vehicle 2 for pivoting from side to side about a substantially vertical axis y to steer vehicle 2 as denoted by the arrows A and B in FIG. 5. Steering wheel 14 is operably connected to the front wheel support 16 in any suitable manner, e.g. using belts, chains, or a power steering cylinder, to pivot support 16 as the operator turns or rotates steering wheel 14.

Figure 2:
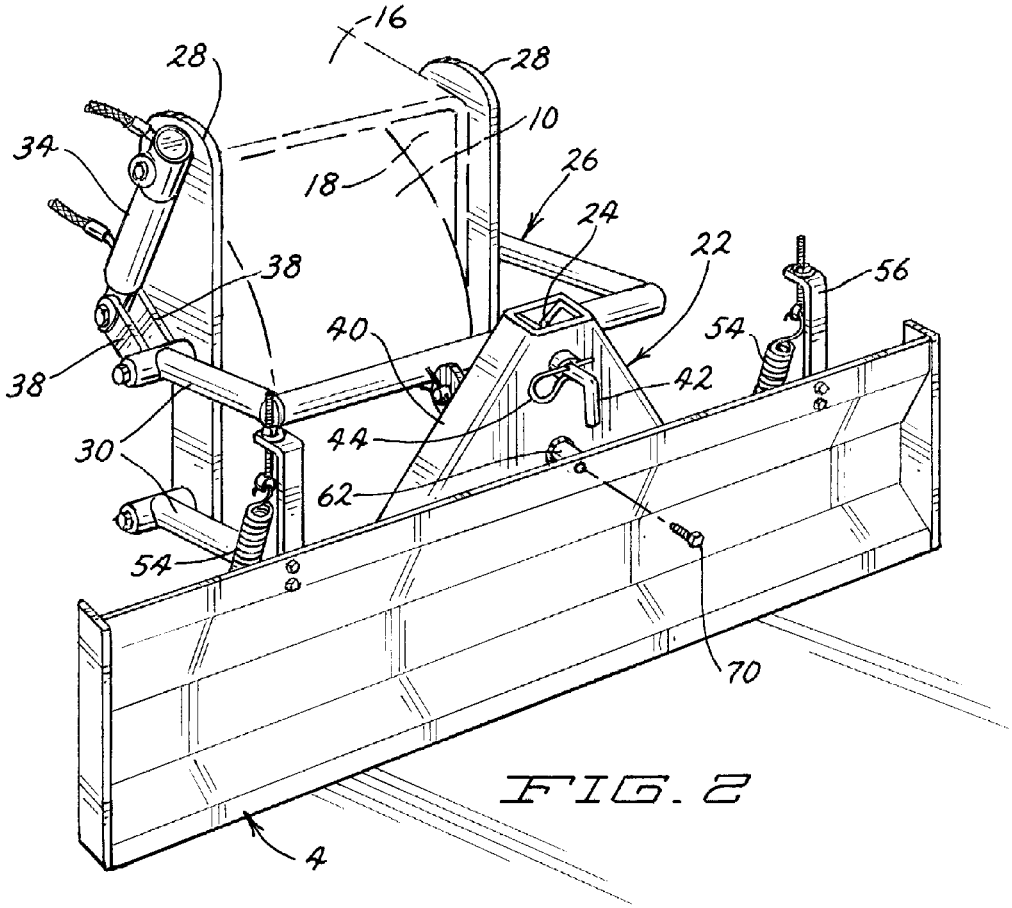
FIG. 2 is an enlarged perspective view of the front bulldozer blade shown in FIG. 1.
Figure 3:
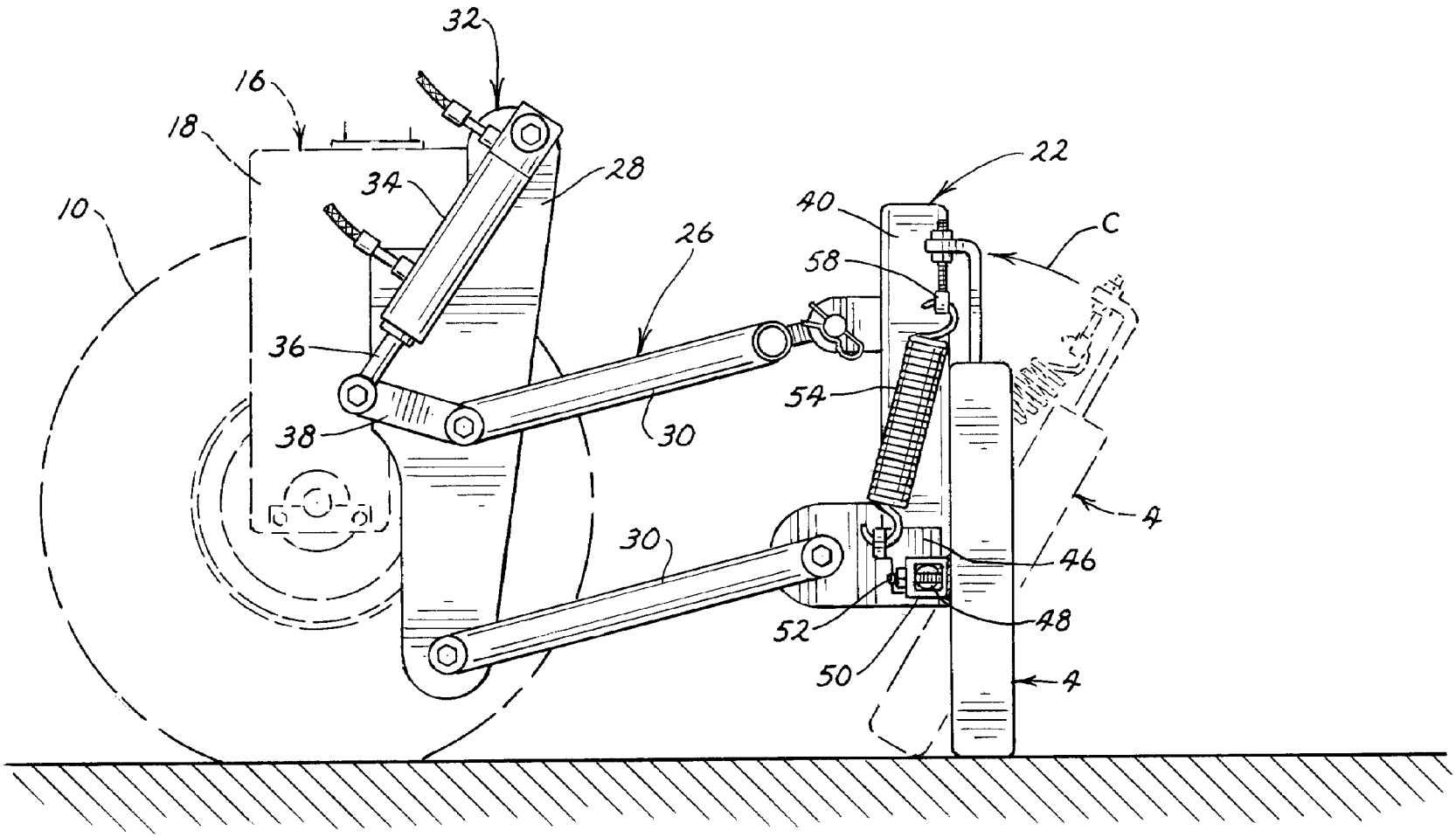
FIG. 3 is a side elevational view of the front bulldozer blade shown in FIG. 1, particularly illustrating the blade in a generally upright position in solid lines in which the blade provides maximum grading effort and in a rotated or pivoted inclined position in phantom lines in which the blade provides less grading effort.
Figure 4:
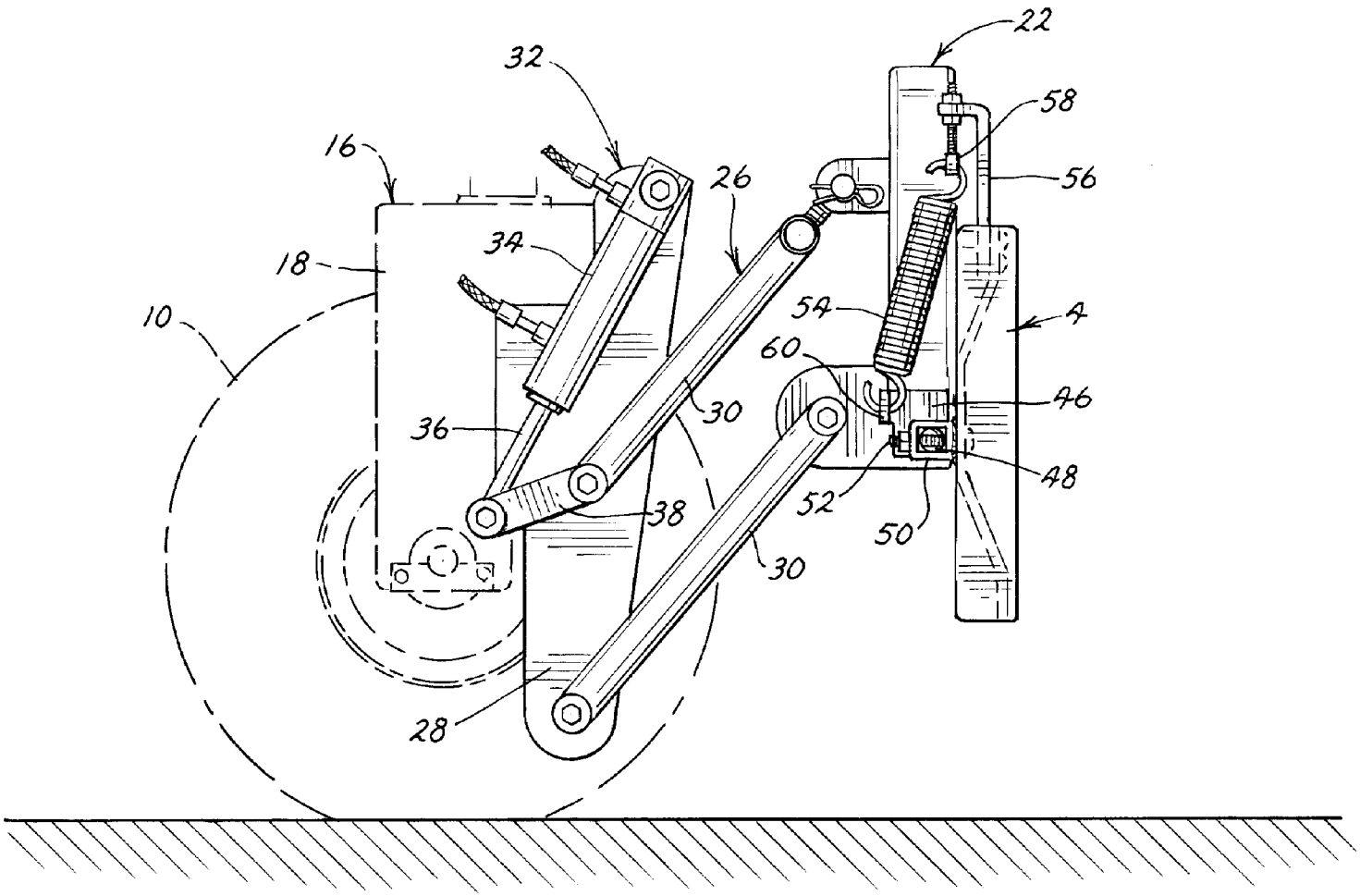
FIG. 4 is a side elevational view of the front bulldozer blade shown in FIG. 1, particularly illustrating the blade in a raised position relative to the vehicle.

An A-frame quick attachment 22 is carried on pivotal support 16 of front wheel 10. Quick attachment 22 comprises an A-shaped male coupler 24 that is pivotally attached to a four bar linkage 26 for connecting male coupler 24 to support 16. As shown in FIGS. 1-3, the downwardly extending legs 18 of support 16 carry support plates 28 to which the rear ends of bars 30 of four bar linkage 26 are pivotally connected. Four bar linkage 26 allows male coupler 24 and anything coupled to male coupler 24 to move up and down while remaining substantially vertically upright during such upward and downward motion.

A powered actuator 32 is provided on one support plate 28 for pivoting four bar linkage 26 to raise and lower male coupler 24 of quick attachment 22. Actuator 32 comprises a hydraulic cylinder 34 carried on one of the support plates 28 that mount four bar linkage 26. The piston rod 36 of the cylinder 34 is coupled by a pair of links 38 to one of the bars 30 in four bar linkage 26. See FIG. 2. Thus, extension and retraction of piston rod 36 in cylinder 34 rotates four bar linkage 26 in one direction or the other to raise and lower male coupler 24.

An A-shaped female coupler 40 is also part of quick attachment 22. Female coupler 40 has an A-shaped cavity that is designed to mate with and receive the A-shaped male coupler 24 when female coupler 40 is dropped down over male coupler 24. After the female and male couplers are nested together in this manner, couplers 24 and 40 are further locked together and prevented from moving vertically relative to one another by a lock pin 42. A cotter pin 44 may be used to keep lock pin 42 in place. See FIG. 2.

Quick attachment 22 as used herein is of the same type disclosed in U.S. Pat. No. 6,347,671 to Stiller et al., which is incorporated by reference herein.

Blade 4 is pivotally connected to the bottom of female coupler 40 such that blade 4 is pivotally attached to or carried by female coupler 40. In other words, blade 4 and female coupler 40 normally comprise a single unit and are installed or removed from male coupler 24 as a single unit.

Figure 5:
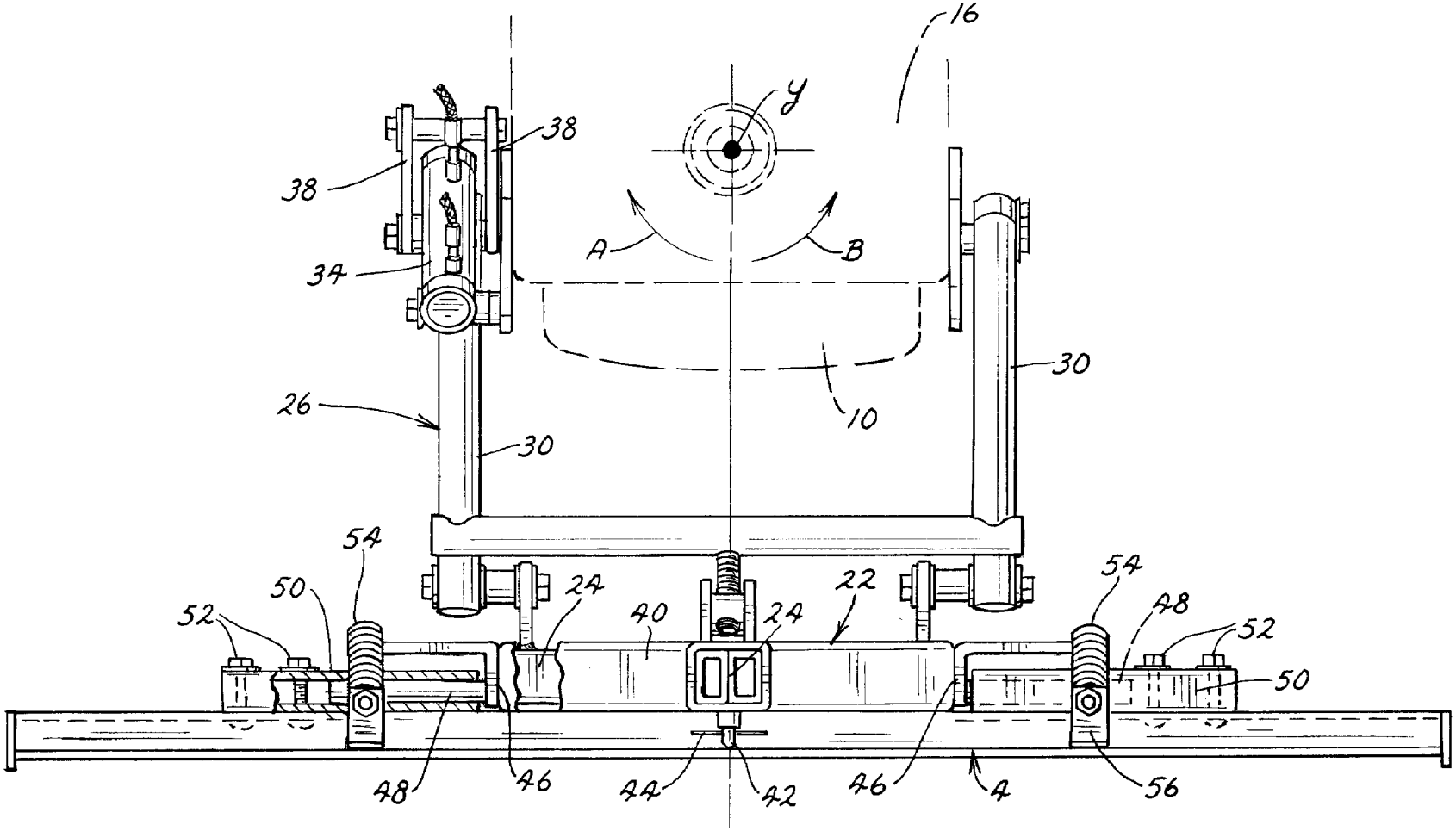
FIG. 5 is a top plan view of the front bulldozer blade shown in FIG. 1.

The pivotal connection between blade 4 and female coupler 40 made be made in any suitable fashion. As shown in FIGS. 3 and 5, each side of female coupler 40 is provided with a plate 46 that carries a laterally extending stub shaft 48 with the two stub shafts 48 being on a common axis. The rear of blade 4 includes two hollow pivot sleeves 50 either bolted by bolts 42 or welded to the rear of blade 4. Pivot sleeves 50 pivotably journal blade 4 on stub shafts 48 with one stub shaft 48 being received inside each pivot sleeve 50. See FIG. 5. Thus, blade 4 can rotate or pivot on stub shafts 50 as shown by the solid and phantom line illustrations in FIG. 3.

A pair of biasing springs 54 are provided for yieldably biasing blade 4 into a generally upright position as shown in solid lines in FIG. 3. In this regard, each side of blade 4 carries a vertical arm 56 projecting upwardly above an upper edge of blade 4. Arm 56 includes a vertically adjustable eyelet 58 in which one end of a biasing spring 54 is hooked. The other end of biasing spring 54 is hooked in a fixed eyelet 60 that also projects laterally from each plate 46 on each side of female coupler 40. Springs bias blade 4 in a counter-clockwise pivoting motion relative female coupler 40 as denoted by the arrow C in FIG. 3. This pivoting motion is stopped when the rear of blade 4 abuts against a forwardly projecting stop or spacer 62 on the front of female coupler 40. See FIG. 2.

Blade 4 can be quickly installed on and removed from vehicle 2. To install the blade, the operator need only lift the blade up and drop female coupler 40 down over male coupler 24 of quick attachment 22. Lock pin 42 and cotter pin 44 can then be installed. This is very easy and can be done very quickly. To remove the blade, the reverse process is used, namely cotter pin 44 and lock pin 42 are removed and female coupler 40 is lifted up and off male coupler 24. The ease with which this can be done encourages the operator to remove blade 4 when it is otherwise not needed and to install blade 4 only when a sand grading and moving operation is needed.

Figure 6:
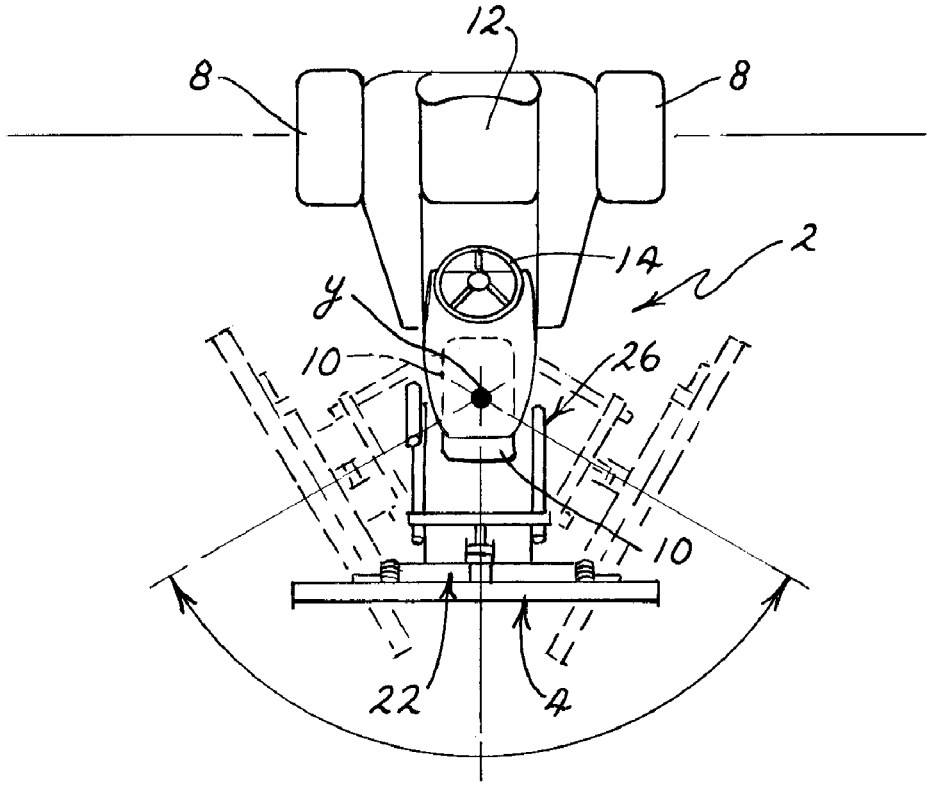
FIG. 6 is a diagrammatic top plan view of the sand grooming vehicle and front bulldozer blade shown in FIG. 1, particularly illustrating how the front bulldozer blade pivots or steers with the pivotable steerable front wheel of the vehicle.

In operating vehicle 2 with blade 4 in place, blade 4 will steer or turn with front wheel 10 as front wheel 10 is turned to steer vehicle 2. This is depicted in FIG. 6. Effectively blade 4 steers in concert with front wheel 10. Thus, blade 4 more naturally tracks the movement of vehicle 2 and is much less prone to catching the edge of a bunker when the operator is driving along the edge of the bunker. This is an advantage over prior art blades that are attached to frame 6 of vehicle 2 rather than being attached to front wheel 10 as disclosed herein.

The fact that blade 4 is pivotally mounted on female coupler 40 and is yieldably connected thereto by springs 54 also provides other advantages. Blade 4 has less of a tendency to dig into the sand because blade 4 naturally pivots into an inclined position where it has less grading effectiveness when blade 4 becomes loaded with sand. Thus, vehicle 2 when grading the sand in the bunker is easier to operate as the operator need not control the grading effectiveness of blade 4 by constantly raising and lowering blade 4 using hydraulic cylinder 34. Instead, hydraulic cylinder 34 is used primarily to raise blade 4 at the end of a grading pass and to lower blade 4 at the beginning of a grading pass with blade 4 automatically pivoting relative to female coupler 40 as needed during the grading pass.

If desired, blade 4 can be locked or held in its upright position by inserting a bolt or machine screw 70 through the front of blade 4 into spacer 62. Other means of locking blade 4 to female coupler 40 could be used. This will lock out the yieldable pivoting of blade 4 and cause blade 4 to act much like a rigid prior art grading blade. In the locked position, blade 4 is able to push more sand than when blade 4 is allowed to float or pivot relative to female coupler 40.

Other implements could desirably be attached to female coupler 40 so as to pivot or steer with front wheel 10. One such implement could comprise a blower (not shown) fixed to female coupler 40 and arranged so that the outlet of the blower points generally straight ahead in front of vehicle 2. Such a blower could be driven by a hydraulic motor (not shown) and hydraulic fluid received from a suitable source. For example, a pair of hydraulic fluid supply and return lines could connect the hydraulic motor driving the blower to a pair of quick couplers (not shown) carried on the front of vehicle 2 adjacent front wheel support 16, such quick couplers leading to a hydraulic pump or the like carried on vehicle 2. Thus, as vehicle 2 is driven by the operator, the hydraulic motor connected to the blower would drive the blower to blow air ahead of vehicle 2 in a stream aligned with front wheel 10.

In the above described alternative where a blower is mounted on female coupler 40 in place of blade 4, the blower will pivot or steer in concert with front wheel 10 since it will be connected or carried by front wheel support 16. Thus, the operator could easily use such a blower to blow leaves off a cart path or the like simply by turning front wheel 10 in whatever direction is needed to blow the leaves. This could be done when vehicle 2 is stationary or even when vehicle 2 is moving.

For example, as vehicle 2 is driven slowly forwardly, the operator could swing front wheel 10 from side to side in a slightly weaving path of vehicle 2 to sweep the blower outlet from side to side relative to the path in a leaf sweeping or clearing action. Alternatively, if the path is narrow, simply directing the stream straight ahead by leaving front wheel 10 straight may be sufficient to clear the path of leaves. In any event, the operator can advantageously direct the stream exiting from the blower simply by steering front wheel 10 in the desired direction.

A quick attachment 22 could also be provided on the rear of vehicle 2 to allow various trailing implements to be more quickly installed on and removed from vehicle 2. For example, a box scraper used for grading dirt or the typical trailing sand grooming rake could be mounted to a female coupler 40. The rear of vehicle 2 would carry a male coupler 24. Male coupler 24 could be coupled to the rear of vehicle 2 in any suitable way including by using a four bar linkage 26. In any event, the box scraper, the sand grooming rake, or any other desired implement carried on female coupler 40 could be quickly and easily mounted to the rear of vehicle 2 by dropping female coupler 40 down over a rear mounted male coupler 24. To accommodate a rear mounted implement powered by its own hydraulic motor, a pair of quick couplers leading to the hydraulic pump on vehicle 2 could also be carried on the rear of vehicle 2 as well as on the front of vehicle 2.

If a quick attachment 22 and a pair of quick couplers were carried on the rear of vehicle 2, the previously described blower could be also be carried on the rear of vehicle 2 as well as on the front of vehicle 2. Thus would depend upon whether the front quick attachment 22 or the rear quick attachment 22 was used to mount blower 2.

If the blower were used on the rear of vehicle 2, the blower outlet would desirably point to the side of vehicle 2 rather than pointing straight behind vehicle 2. For a blower intended for dual use on either the front or the rear of vehicle 2, the blower would desirably be hinged to female coupler 40 such that the orientation of the blower outlet could be selectively changed on female coupler 2 from a first longitudinal direction to a second lateral direction that is perpendicular to the first direction. This would permit the orientation of the blower outlet to be changed from the lateral direction pointing to one side of vehicle 2 for use when the blower is rear mounted on vehicle 2 to the longitudinal direction pointing forwardly relative to vehicle 2 for use when the blower is front mounted on front wheel support 16. Alternatively, two different blowers could be provided with fixed, non-adjustable directions for the blower outlet for separate use depending upon whether a front or rear mounted blower is desired.

Vehicle 2 and blade 4 are not limited for use with sand, but may be used with any loose granular material, such as loosely packed dirt or the like on baseball diamond infields.

Various other modifications of this invention will be apparent to those skilled in the art. For example, mounting blade 4 on front wheel 10 to pivot with front wheel 10 is advantageous even if blade 4 were not yieldably pivotal on the bottom of female coupler 40 or even if blade 4 were not connected to vehicle 2 by quick attachment 22. Thus, the scope of this invention is to be limited only by the appended claims.

I claim:

1. A grooming vehicle, which comprises:

(a) a frame supported for movement over the ground by a plurality of ground engaging wheels including a steerable front wheel, wherein the front wheel is rotatably journalled on a support that pivots on the frame about a substantially vertical pivot axis, wherein the front wheel support includes a pair of downwardly extending legs that are spaced apart by more than the width of the front wheel such that the legs straddle the front wheel, and wherein at least one wheel is driven to self-propel the frame over the ground;

(b) a quick attachment comprising A-shaped male and female couplers, the couplers interfitting with one another with the female coupler nesting at least partially over the male coupler;

(c) a linkage for connecting the A-shaped male coupler to a front of the frame, wherein the linkage includes at least one bar pivotally connecting each side of the male coupler to one of the downwardly extending legs of the front wheel support; and (d) a blade carried on the female coupler for pushing granular material, wherein the blade can be attached to the front of the frame by nesting the female coupler over the male coupler.

2. The vehicle of claim 1, wherein the linkage is a pivotal four bar linkage in which a pair of parallel bars pivotally connect each of the downwardly extending legs of the front wheel support to the male coupler.

3. The vehicle of claim 1, wherein the blade is pivotal about a substantially horizontal pivot axis relative to the female coupler.

4. The vehicle of claim 3, further including a lock that is selectively actuable by a user for locking the blade against pivoting relative to the female coupler.

5. A grooming vehicle, which comprises:

(a) a frame supported for movement by a plurality of ground engaging wheels comprising two rear wheels and a steerable front wheel, wherein at least some of the wheels are driven to allow the frame to be self-propelled;

(b) a support on which the steerable front wheel is rotatably journalled, the front wheel support being further pivotal about a vertical pivot axis to pivot the front wheel from side to side to steer the vehicle;

(c) a ground grooming implement carried on the front wheel support of the steerable front wheel to pivot with the front wheel about the vertical pivot axis as the front wheel pivots about the vertical pivot axis, wherein the implement comprises a bulldozer blade for pushing granular material;

(d) a vertically movable linkage mounted on and carried by the front wheel support with the linkage extending between and connecting the implement to the front wheel support to allow the implement to be raised and lowered relative to the front wheel support by raising and lowering the linkage, wherein the vertically movable linkage comprises a four bar linkage which is configured to raise and lower the implement relative to the front wheel support without substantially pivoting the implement relative to the front wheel support, and wherein the blade is also pivotal about a substantially horizontal axis relative to the four bar linkage when pushing the granular material;

(e) a powered actuator mounted on and carried by the front wheel support with the actuator being connected to the movable linkage for raising and lowering the linkage to thereby raise and lower the implement relative to the front wheel support; and (f) a lock that is selectively actuable by a user for locking the blade against pivoting about the substantially horizontal axis.

6. The vehicle of claim 1, wherein the four bar linkage includes at least one pair of parallel bars pivotally connected at one end to the front wheel support.

7. The vehicle of claim 6, wherein the parallel bars are pivotally connected at another end to the implement through a quick attachment.

8. The vehicle of claim 7, wherein the quick attachment is an A-shaped quick attachment.

9. The vehicle of claim 1, wherein the blade is spring biased into a generally upright orientation, wherein the blade is pivotal about the substantially horizontal axis against the spring bias to be yieldably urged into the generally upright orientation.

10. The vehicle of claim 1, wherein the powered actuator comprises a housing and an extensible and retractible rod projecting from the housing which rod has powered motion back and forth on the housing caused by motive means in the housing, the housing, rod and motive means of the actuator all being carried on the pivotal front wheel support.

11. A grooming vehicle for pushing and grading sand in a sand trap or bunker, which comprises:

(a) a frame supported by a plurality of ground engaging wheels with air filled tires, at least one of the wheels comprising a steerable front wheel, the frame having a seat for carrying a seated operator and a source of power for driving at least some of the ground engaging wheels so that the frame is self propelled, wherein the frame has an overall weight and weight distribution and the tires have a pressure and width that are sufficient to support the frame and a seated operator atop the sand in the sand trap or bunker without substantially sinking into the sand;

(b) a blade coupled by an attachment to a front of the frame for pushing the sand in the sand trap or bunker, wherein the blade is coupled by the attachment to the steerable front wheel on the frame such that the attachment and the blade steer in concert with the front wheel;

(c) wherein the blade is pivotally connected to the attachment for pivoting about a substantially horizontal axis relative to the attachment when the blade is in engagement with the sand to allow the blade to become more or less inclined relative to the sand as the vehicle traverses over the sand in the sand trap or bunker;

(d) at least one spring operatively connected between the blade and the attachment with the spring being arranged such that pivoting of the blade is opposed by the bias of the at least one spring when the blade pivots in one direction during forward movement of the frame, wherein the blade has a top and a bottom and the bottom of the blade swings rearwardly when the blade pivots in the one direction; and (e) wherein the bias of the at least one spring is chosen to allow the blade to pivot against the bias of the at least one spring when the bottom of the blade becomes loaded with the sand being pushed by the blade to thereby cause the blade to automatically become more inclined relative to the sand in the sand trap or bunker to lessen the grading effectiveness of the blade without changing the vertical position of the blade.

12. A grooming vehicle for pushing and grading sand in a sand trap or bunker, which comprises:

(a) a frame supported by a plurality of ground engaging wheels with air filled tires, the frame having a seat for carrying a seated operator and a source of power for driving at least some of the ground engaging wheels so that the frame is self propelled, wherein the frame has an overall weight and weight distribution and the tires have a pressure and width that are sufficient to support the frame and a seated operator atop the sand in the sand trap or bunker without substantially sinking into the sand;

(b) a blade coupled by an attachment to a front of the frame for pushing the sand in the sand trap or bunker, wherein the attachment is pivotally carried on and coupled to the frame through a pivotal four bar linkage;

(c) wherein the blade is pivotally connected to the attachment for pivoting about a substantially horizontal axis relative to the attachment when the blade is in engagement with the sand to allow the blade to become more or less inclined relative to the sand as the vehicle traverses over the sand in the sand trap or bunker;

(d) at least one spring operatively connected between the blade and the attachment with the spring being arranged such that pivoting of the blade is opposed by the bias of the at least one spring when the blade pivots in one direction during forward movement of the frame, wherein the blade has a top and a bottom and the bottom of the blade swings rearwardly when the blade pivots in the one direction; and (e) wherein the bias of the at least one spring is chosen to allow the blade to pivot against the bias of the at least one spring when the bottom of the blade becomes loaded with the sand being pushed by the blade to thereby cause the blade to automatically become more inclined relative to the sand in the sand trap or bunker to lessen the grading effectiveness of the blade without changing the vertical position of the blade.

13. A grooming vehicle for pushing and grading sand in a sand trap or bunker, which comprises:

(a) a frame supported by a plurality of ground engaging wheels with air filled tires, the frame having a seat for carrying a seated operator and a source of power for driving at least some of the ground engaging wheels so that the frame is self propelled, wherein the frame has an overall weight and weight distribution and the tires have a pressure and width that are sufficient to support the frame and a seated operator atop the sand in the sand trap or bunker without substantially sinking into the sand;

(b) a blade coupled by an attachment to a front of the frame for pushing the sand in the sand trap or bunker, wherein the attachment is pivotally carried on the frame, wherein the attachment is a quick attachment having male and female couplers, one coupler being attached to the frame and the other coupler being attached to the blade, and wherein the couplers are A-shaped;

(c) wherein the blade is pivotally connected to the attachment for pivoting about a substantially horizontal axis relative to the attachment when the blade is in engagement with the sand to allow the blade to become more or less inclined relative to the sand as the vehicle traverses over the sand in the sand trap or bunker;

(d) at least one spring operatively connected between the blade and the attachment with the spring being arranged such that pivoting of the blade is opposed by the bias of the at least one spring when the blade pivots in one direction during forward movement of the frame, wherein the blade has a top and a bottom and the bottom of the blade swings rearwardly when the blade pivots in the one direction; and (e) wherein the bias of the at least one spring is chosen to allow the blade to pivot against the bias of the at least one spring when the bottom of the blade becomes loaded with the sand being pushed by the blade to thereby cause the blade to automatically become more inclined relative to the sand in the sand trap or bunker to lessen the grading effectiveness of the blade without changing the vertical position of the blade.

* * * * *